US007322553B2

(12) United States Patent
Rexroad

(10) Patent No.: US 7,322,553 B2
(45) Date of Patent: Jan. 29, 2008

(54) CORNER EXTENSION MOUNTING BRACKET

(76) Inventor: John Rexroad, 500 Main St., P.O. Box 1019, Deep River, CT (US) 06417

( * ) Notice: Subject to any disclaimer, the term of this patent is extended or adjusted under 35 U.S.C. 154(b) by 283 days.

(21) Appl. No.: 11/089,752

(22) Filed: Mar. 24, 2005

(65) Prior Publication Data

US 2006/0214071 A1 Sep. 28, 2006

(51) Int. Cl.
*E44G 3/00* (2006.01)

(52) U.S. Cl. ..... 248/274.1; 182/138

(58) Field of Classification Search ..... 248/200, 248/276.1, 274.1, 284.1, 291.1, 125.7, 72, 248/229.15, 229.25, 229.12, 229.22; 182/138
See application file for complete search history.

(56) References Cited

U.S. PATENT DOCUMENTS 4,856,615 A * 8/1989 Nusbaum ..... 182/82
4,892,169 A * 1/1990 Duncan ..... 182/138
5,029,670 A * 7/1991 Whitmer ..... 182/113
5,429,206 A * 7/1995 Nusbaum ..... 182/138
6,068,058 A * 5/2000 Ellis et al. ..... 169/74

* cited by examiner

*Primary Examiner*—Ramon O Ramirez
(74) *Attorney, Agent, or Firm*—Venable, Campillo, Logan & Meaney, P.C.

(57) ABSTRACT

Described is a corner extension mounting system used to secure a net system to buildings or structures that have obstructions such as corners. The corner extension mounting system easily and quickly attaches to a floor beam or other structure around the perimeter of a building or structure. The corner extension mounting system includes a mounting bracket, a corner extension, a support bracket, and a cantilever arm. The mounting bracket is adjustable and also reinforces the corner extension and the support bracket. The support bracket attaches to two cantilever arms that are positioned perpendicularly around the corner of a building. The cantilever arms are attached to the support bracket with pivot pins that allow the cantilever arms to rotate. A debris net is suspended between the upper end of the cantilever arm and the building. Among other things, the corner extension mounting system allows for easy installation of a net system around a building or structure undergoing construction or maintenance.

10 Claims, 9 Drawing Sheets

CORNER EXTENSION MOUNTING BRACKET

BACKGROUND

The present invention relates generally to an apparatus used for securing a device to a structure, more particularly, to an apparatus that secures a net system around the perimeter of a building or structure to ensure a safe work area for construction crews, members of the public, and property that are near a building undergoing construction or renovations. Specifically, the present invention utilizes a corner extension mounting bracket that attaches to a variety of sizes of support structures and rigidly secures a net system to a building or other structure under construction, maintenance, or renovation.

A crew maintaining, renovating, or constructing a high-rise building or structure must deal with many hazards in the work environment. Members of the crew on the ground and in the air must be constantly aware of their surroundings to prevent injuries from falls or falling objects. Additionally, the public on the premises of a construction project must be aware of potentially hazardous situations, such as dropped objects falling from above that could cause bodily injury or property damage.

One way to ensure protection of the crew, public, and property is to install a net system that surrounds the perimeter of the building or structure near the area where objects may fall. However, the installation process can be difficult because most buildings or structures have support structures around the perimeter that vary in size and width from building to building. Therefore, there is not one standard size bracket that will attach a net system to every building or structure. Additionally, when there is a column or other obstruction around the corner of a building or structure, it can be difficult to install a net system that will deploy around the obstruction. Because the mounting bracket will have to be measured and changed each time the net system is moved from building to building, this can become problematic and time consuming for a crew trying to install a net system. Additionally, more mounting brackets will have to be placed on a building with an obstruction blocking deployment of a net system around a corner because the net system will not be able to deploy from one mounting bracket around an obstruction. Because the process of installing the bracket is so time consuming, a crew may not take the time to properly secure the net system, ultimately causing serious accidents.

The present invention provides crew members with an easy and secure way to fasten a net system around the perimeter of all sizes of buildings or structures. The present invention is a mounting bracket that includes a separate top piece and bottom piece that are adjustably connected to each other to fit varying sizes of support structures. The top piece and bottom piece each include overlapping members. The outside of the overlapping member of the top piece slides along the inside of the overlapping member of the bottom piece. Further, the overlapping members have holes along their length that are aligned along an axis perpendicular to each other. When the desired distance between the top and bottom pieces is reached to fit on a support structure, a bolt or other securing device is inserted into the holes to secure the top piece and bottom piece of the mounting bracket together. Additionally, an extension plate can be attached to the overlapping members when the support structure is larger than the top and bottom piece can fit around.

Further, the top piece of the mounting bracket includes a slot where the arm of a corner extension beam is inserted.

Included on the corner extension beam is a support bracket where at least one rotatable cantilever arm can be connected. The support bracket can comprise two embodiments. In one embodiment, the support bracket includes a slot for one cantilever beam with a net system attached to extend past an obstruction on a building. In an alternate embodiment, the support bracket includes two slots for two cantilever beams to extend past an obstruction around the corner of a building or structure.

Currently, there are devices that use nets attached to buildings to protect people working on construction crews, members of the public accessing areas below the building or structure, and property on the ground that could be damaged by falling objects. However, each of these devices suffers from several disadvantages. First, the devices are difficult to install on varying sizes of building support structures with obstructions. Because there may be a column or other obstruction on the corner of a building or structure, it may be difficult to install the net system properly around the obstruction. This can cause the installation to become time consuming and may result in an accident caused by human mistakes. Second, the prior art devices are complicated and require a time consuming and inconvenient process to install and secure.

Presently, there is no net system that is easy to install around an obstructed corner of a structure with varying sizes of support structures. For the foregoing reasons, there is a need for a device that would allow construction crews to easily install a mounting bracket that supports a net system around a building or structure with obstructed corners and varying sizes of support structures.

SUMMARY

The present invention is directed to a device that satisfies the needs of providing a mounting system that is easy to install around obstructed corners of structures, providing a mounting system that is adjustable, providing a mounting system that allows a cantilever beam to be folded up against a building or structure for cleaning or in inclement weather conditions, providing a mounting system that quickly and easily secures to support structures, and providing a mounting system that allows deployment of a net system around an obstruction and/or corner of a building or structure.

A mounting system having features of the present invention comprises a mounting bracket, a corner extension beam with an arm, and a support bracket. The arm is coupled to the first end of the corner extension beam, and the support bracket is coupled to the second end of the corner extension beam. Further, the arm of the corner extension beam is coupled to the slot on the top piece of the mounting bracket. This configuration allows the support bracket to rigidly sustain a deployed net system around an obstruction or corner of a building. In addition, the top piece and bottom piece of the mounting bracket are adjustably connected to each other allowing the mounting bracket to easily fit structures with varying dimensions.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C §112, paragraph 6 to define the invention. To the contrary, if the provisions of 35 U.S.C §δ 12, paragraph 6 are sought to be invoked to define the invention(s), the claims will specifically state the phrases "means for" or "step for" and a function, without also reciting in such phrases any structure, material, or act in support of the function.

Moreover, even if the provisions of 35 U.S.C §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 1:
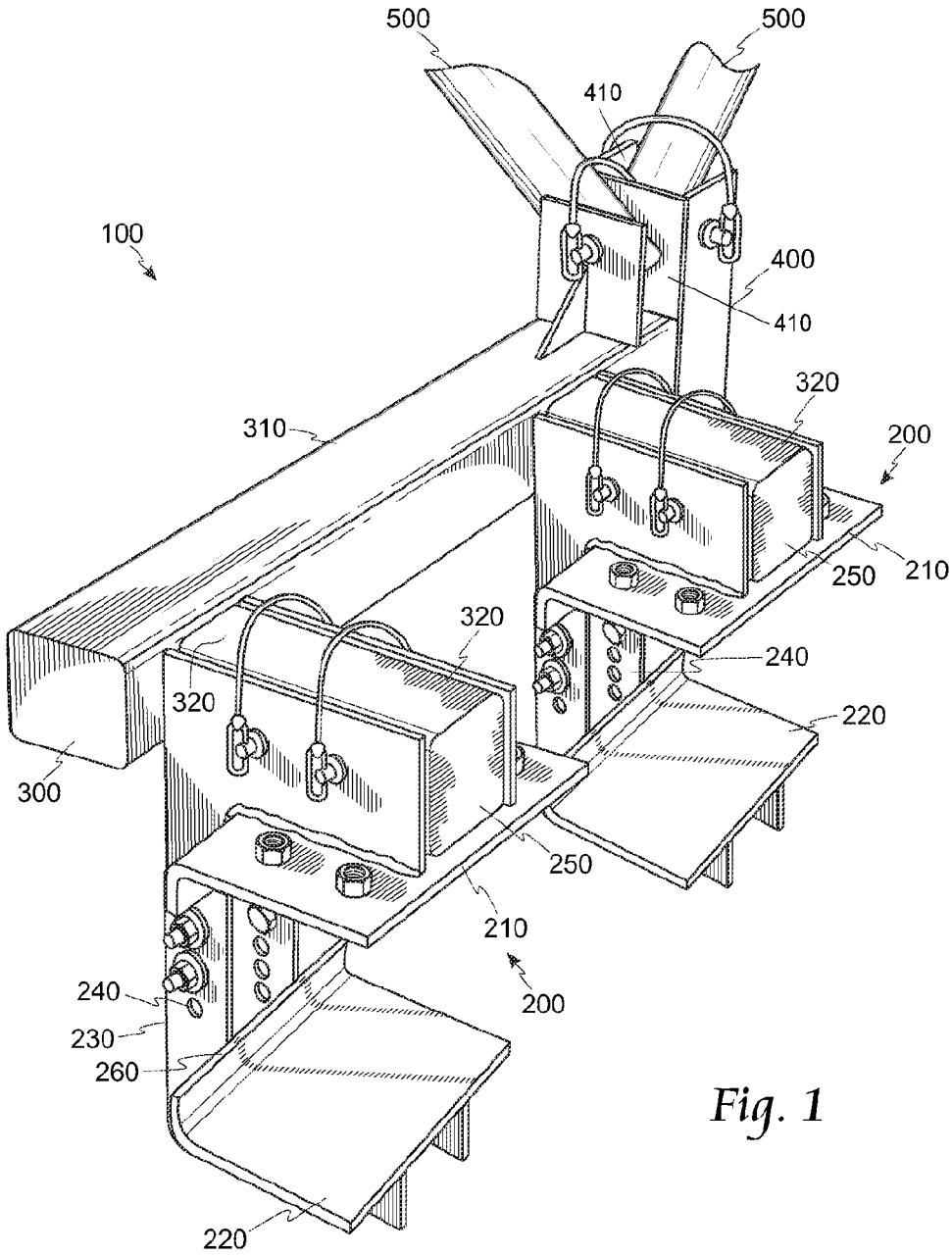
FIG. 1 shows a perspective view of a corner extension mounting system with two mounting brackets.

As shown in FIG. 1, the preferred embodiment of the corner extension mounting system 100 generally includes at least one mounting bracket 200, a corner extension beam 300, a support bracket 400, and at least one cantilever beam 500. These components work together to secure a safety net system to a building or structure with obstructions and varying sizes of support structures. The mounting bracket 200 adjusts its width to fit varying sizes of support structures. Once the desired width of the mounting bracket 200 is achieved, the mounting bracket 200 is secured together by placing fasteners into the holes 240 on the overlapping members 230 of the top piece and bottom piece. The corner extension beam 300 includes at least one arm 320 that fits into the slot 250 on the top piece 210 of the mounting bracket 200 allowing the corner extension beam 300 to extend past the obstruction on the building or structure. The cantilever beam 500 can then be deployed with a safety net attached and not be hindered by the obstructions.

Figure 3:
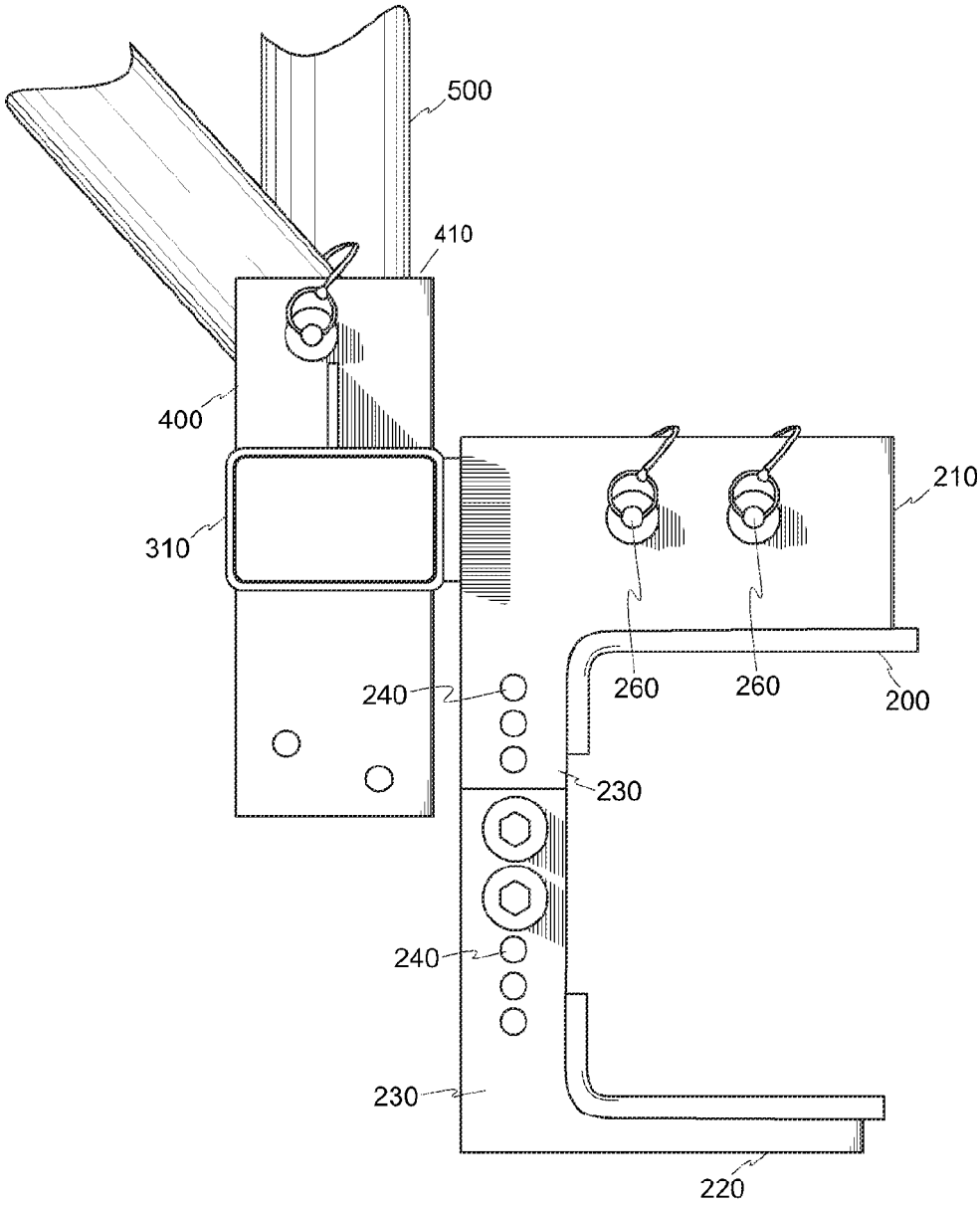
FIG. 3 shows a side view of the corner extension mounting bracket shown in FIG. 1.

As shown in FIG. 3, the mounting bracket 200 includes a top piece 210 and a bottom piece 220 that are adjustably connected to each other. The overlapping members 230 of the top piece 210 and bottom piece 220 of the mounting bracket 200 comprise holes 240 evenly spaced apart. The outside of the overlapping member 230 of the top piece 210 fits on the inside of the overlapping member 230 of the bottom piece 220 such that the holes 240 are aligned along an axis substantially perpendicular to each other and are secured with fasteners 260, such as bolts or pins. This configuration allows the top piece 210 and the bottom piece 220 of the mounting bracket 200 to adjust to fit support structures with varying dimensions. Depending on the size of the support structure, the bottom piece 220 of the mounting bracket 200 can be moved closer to or further away from the top piece 210 without having to detach the corner extension beam 300 from the mounting bracket 200 or changing the entire mounting bracket 200.

Figure 5:
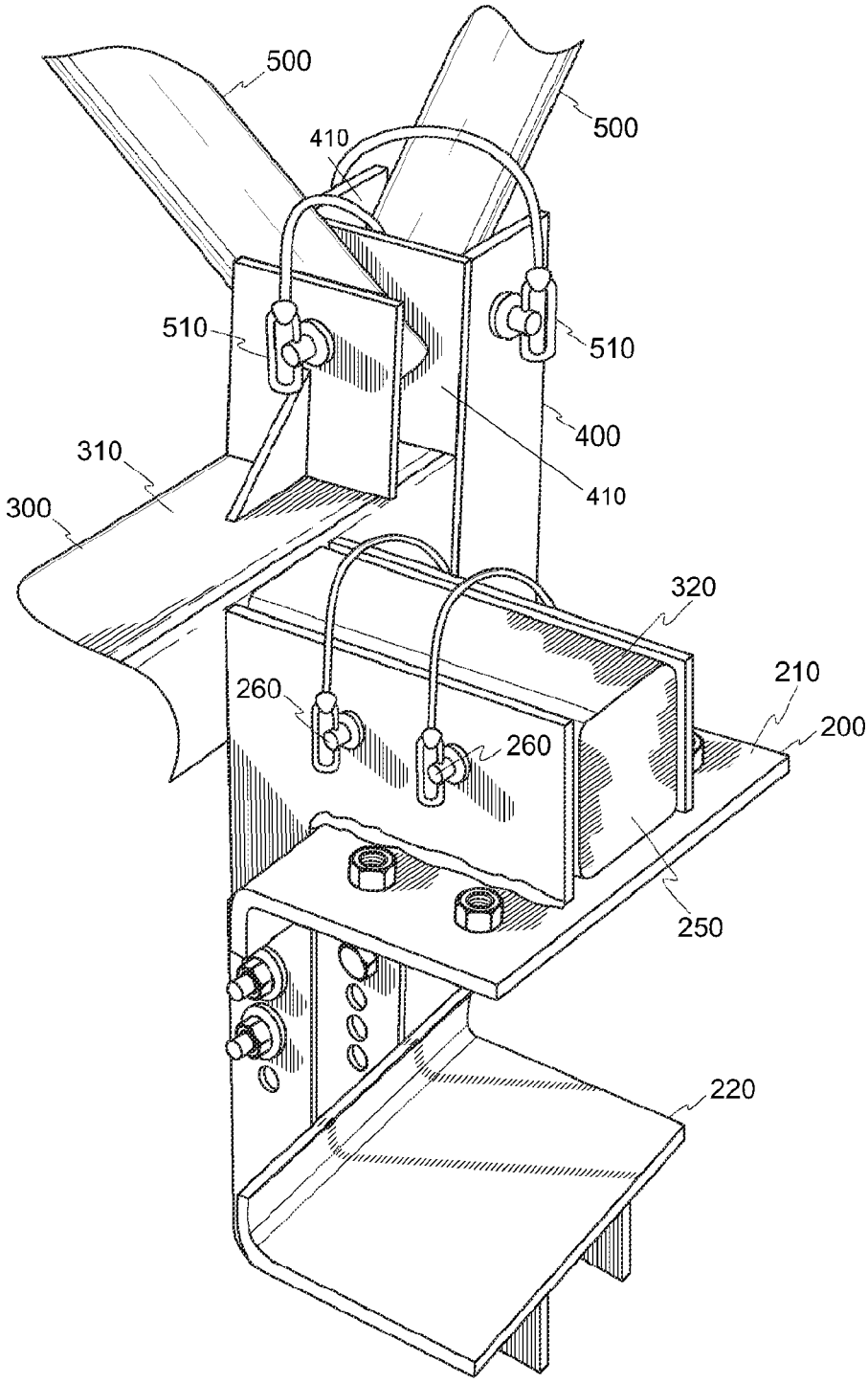
FIG. 5 shows a top view of the mounting bracket and the support bracket with two cantilever arms shown in FIG. 1.

Also shown in FIG. 1 is the corner extension beam 300. Preferably, the corner extension beam 300 includes at one end at least one arm 320 that extends perpendicularly from the beam 300 and fits into the slot 250 on the top piece 210 of the mounting bracket 200. Once in the slot 250, the arm 320 is secured in the slot 250 with fasteners 260, such as bolts or pins that go through the mounting bracket 200 and the arm 320, as shown in FIG. 5.

Figure 4:
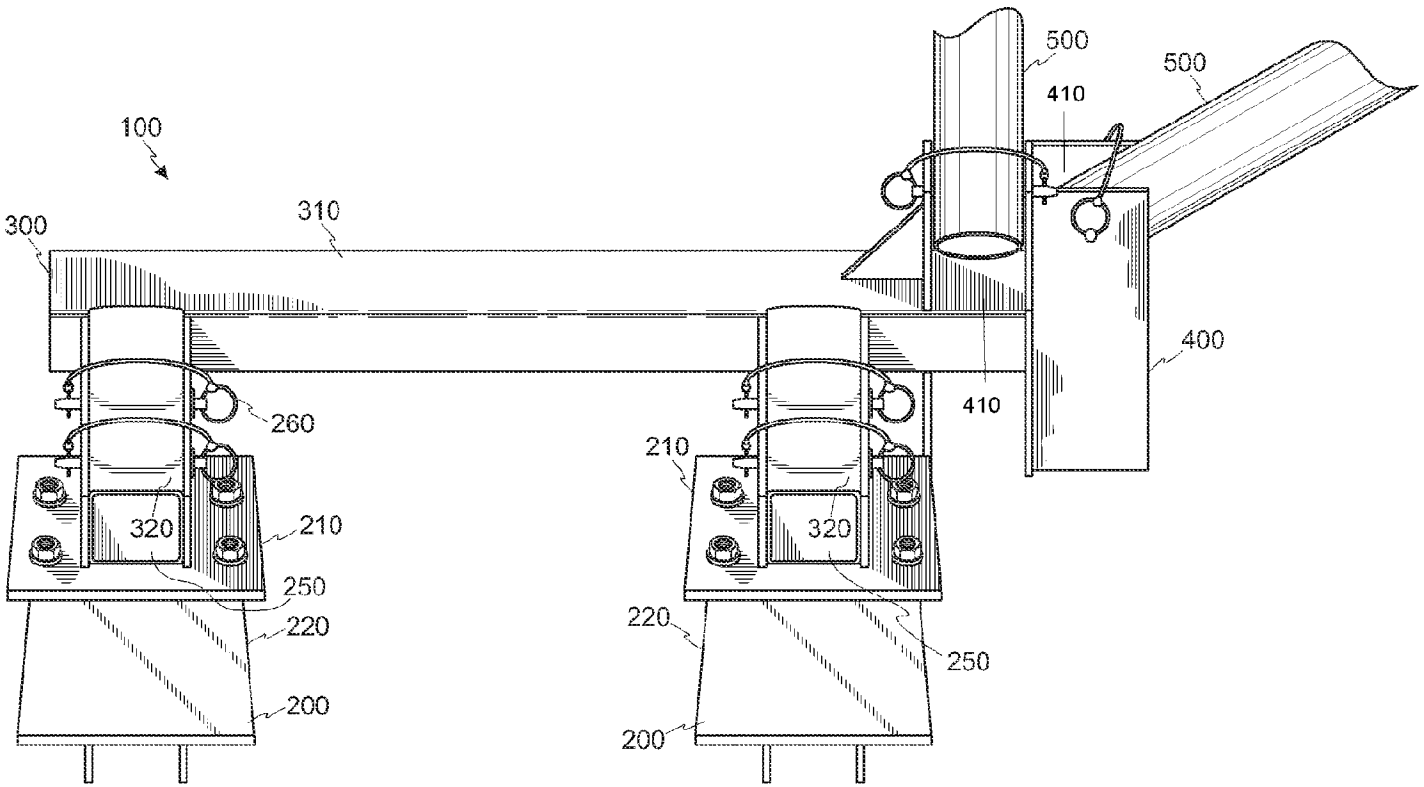
FIG. 4 shows a front view of the corner extension mounting system shown in FIG. 1.

In an alternate embodiment, the mounting system 100 comprises two mounting brackets 200 and a corner extension beam 300 with two arms 320 extending perpendicularly from the corner extension beam 300 as shown in FIG. 4. This embodiment provides more support to the cantilever beam 500 and attached net system.

At the end of the corner extension beam 300 opposite the arm 320 is a support bracket 400. In one embodiment, the support bracket 400 comprises a single beam slot 410. When the support bracket 400 comprises a single beam slot 410, one cantilever beam 500 is attached to the support bracket 400 such that the cantilever beam 500 can rotate. In an alternate embodiment, the support bracket 400 includes two beam slots 410. This configuration allows two cantilever beams 500 to be attached to the support bracket 400. In both embodiments, the support bracket 400 must be placed a sufficient distance from the mounting bracket 200 so that the cantilever beam 500 can be deployed without obstruction.

It is preferred to use the configuration with two cantilever beams 500 when the mounting system 100 is being used on the corner of a building or structure. The cantilever beams 500 are positioned perpendicular to each other, shown in FIGS. 6 and 7, so that each cantilever beam 500 will be on a different side of a corner of a building or structure. In this embodiment, the support bracket 400 must be positioned on the beam 300 far enough away from the nearest mounting bracket 200 or corner structure obstruction so that there will be enough clearance for both cantilever beams 500 to release into an open position around the corner of the building or structure.

Figure 2:
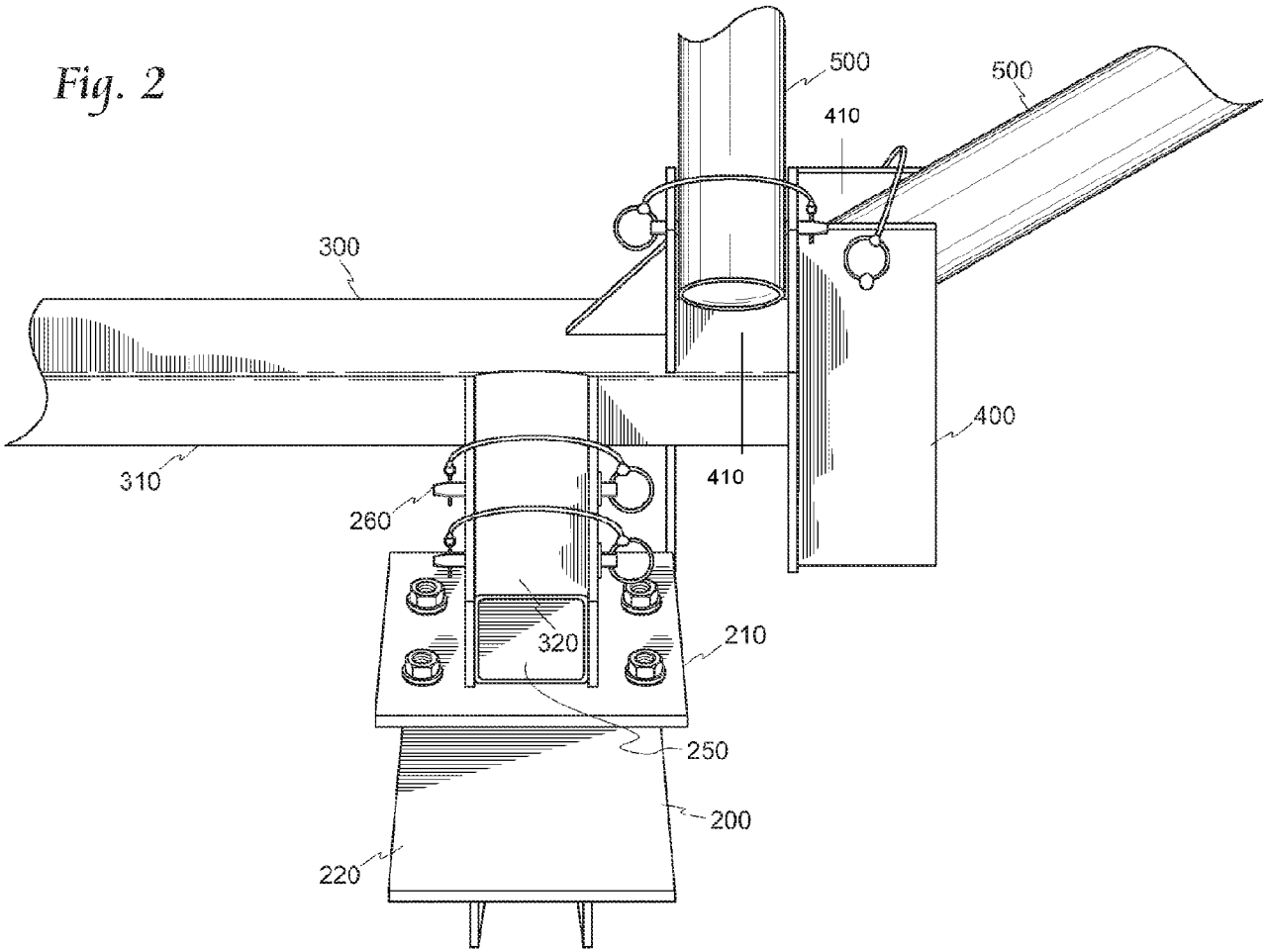
FIG. 2 shows a view of the mounting bracket, shown in FIG. 1, and the end of the corner extension beam attached to the support bracket and two cantilever arms.
Figure 6:
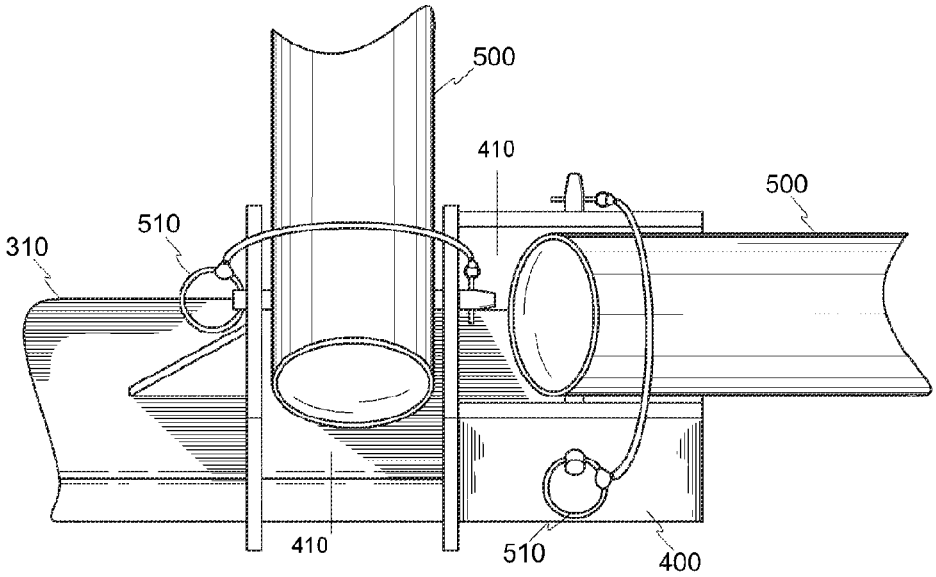
FIG. 6 shows a top view of the support bracket and two cantilever arms attached with pivot pins.
Figure 7:
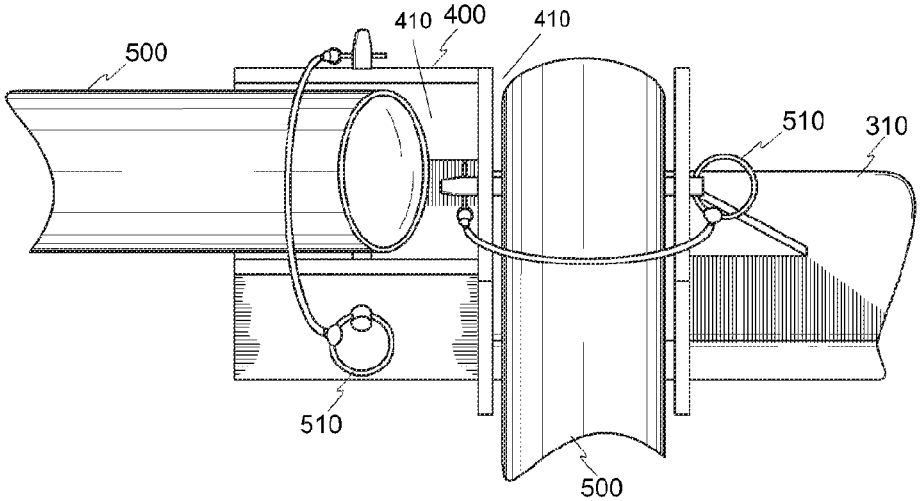
FIG. 7 is the same as FIG. 6 rotated 180°.
Figure 8:
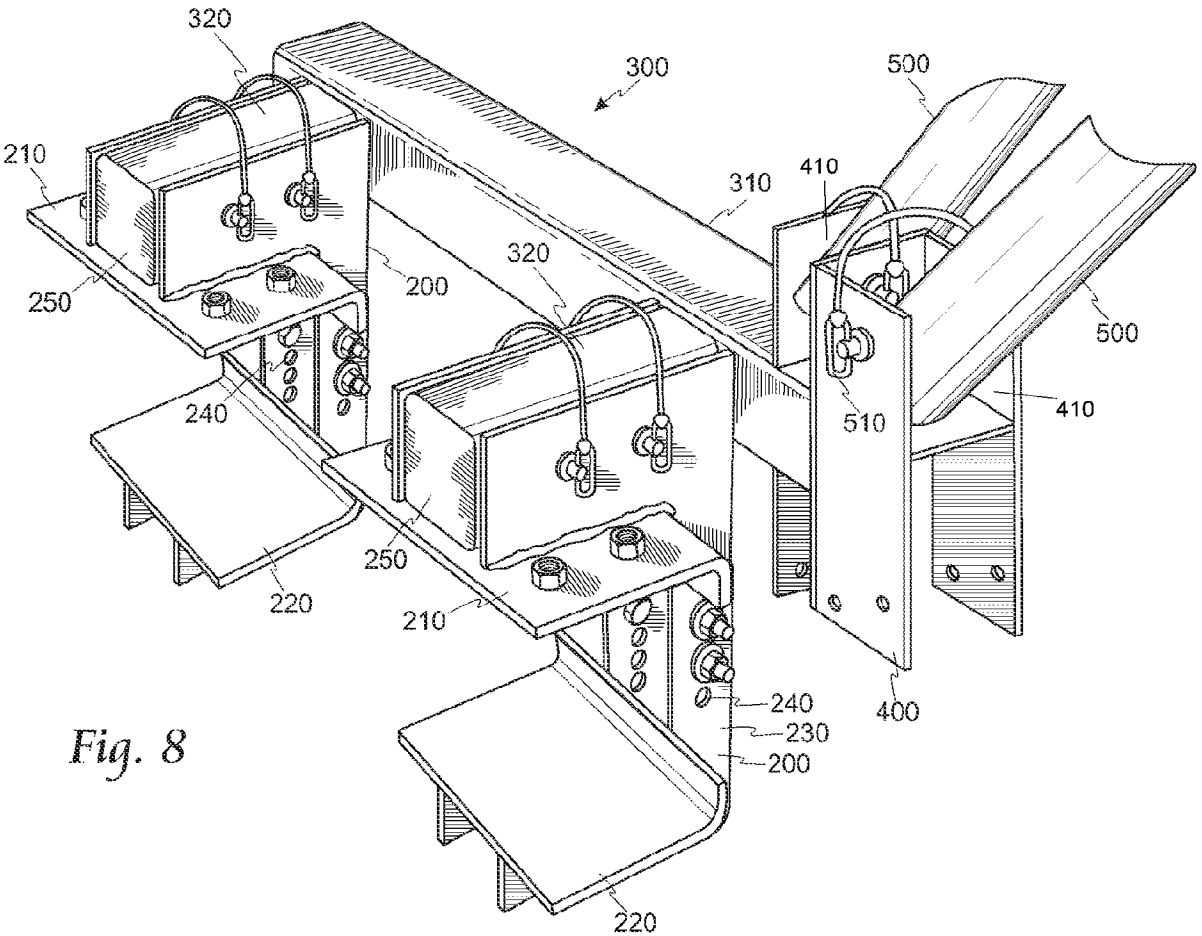
FIG. 8 shows a perspective view of the corner extension mounting system with the cantilever beams parallel to one another.
Figure 9:
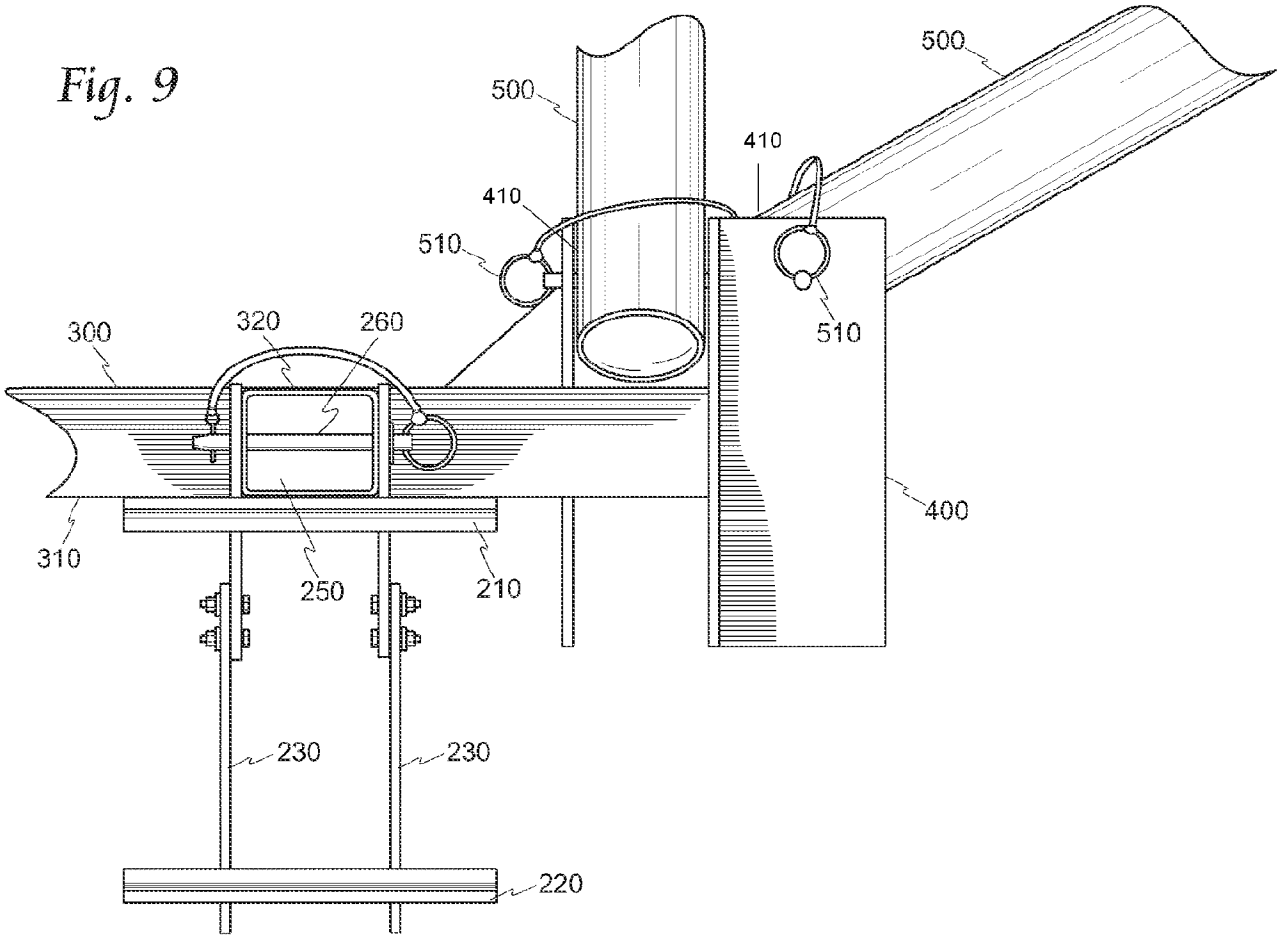
FIG. 9 shows a front view of the mounting bracket with the arm of the support mount inserted into the slot on the mounting bracket.
Figure 10:
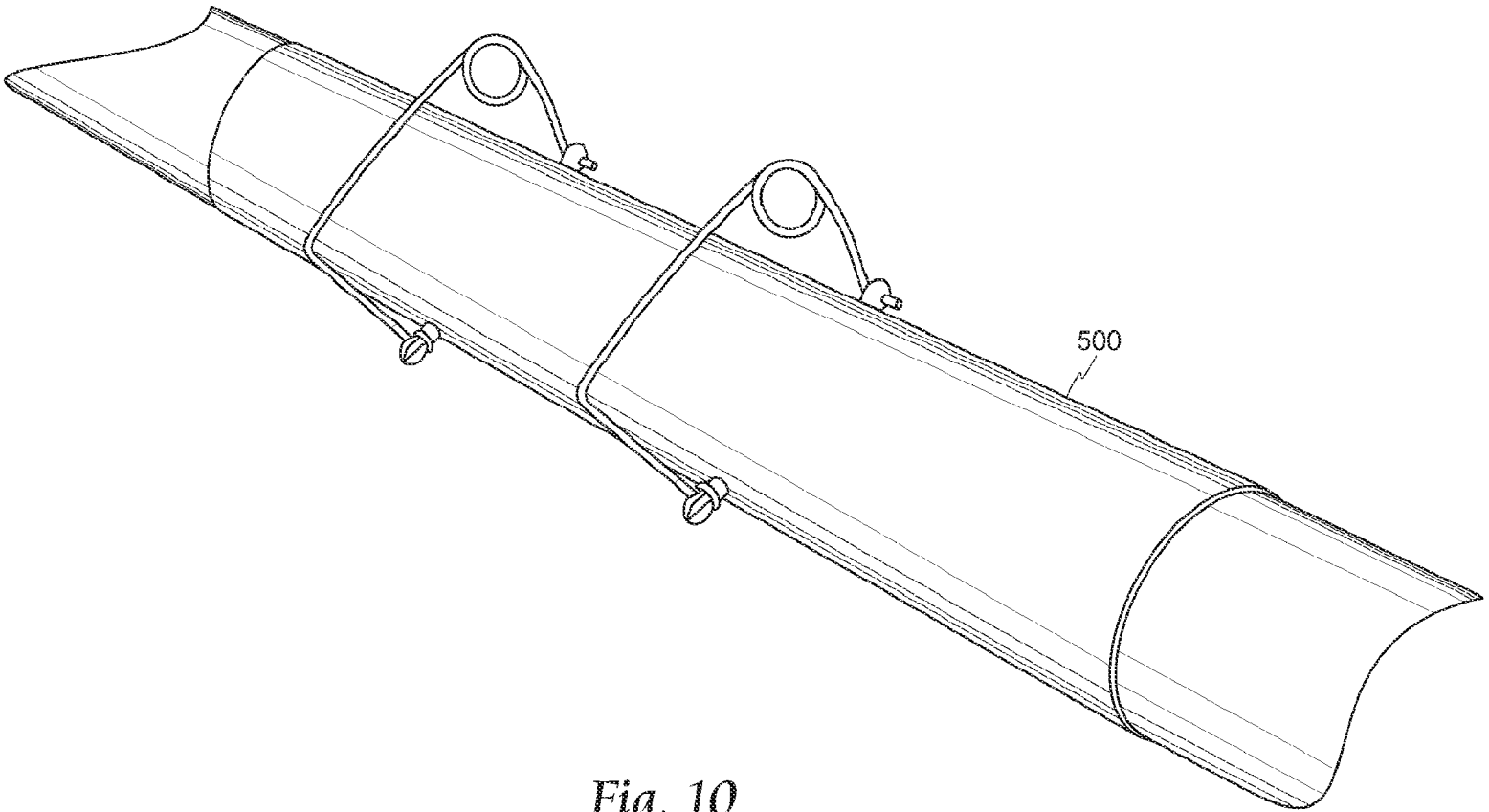
FIG. 10 shows a view of the cantilever beam

The cantilever beams 500 are attached to the support bracket 400 with pivot pins 510 as shown in FIGS. 6 and 7. The pivot pins 510 allow the cantilever beams 500 to rotate between a closed and open position. As illustrated in. FIGS. 8 and 9, when the cantilever beams 500 are in a closed position, the safety net is folded against the building. When the cantilever beams 500 are in the closed position, the crew can easily make repairs to the attached net system and protect the net system from inclement weather, such as wind. Alternatively, when the cantilever beams 500 are in an open position, the safety net is open and in a position to provide protection to workers, the public, and property as shown in FIG. 2 by catching falling objects. As depicted in FIG. 10, the cantilever beams 500 can consist of two parts so that the cantilever beam 500 can be extended and to aid in shipping.

The preferred embodiment of the invention is described above, in the Drawings, and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A mounting system comprising:

A. a mounting bracket, said mounting bracket further comprising:

1. a top piece, said top piece further comprising a slot; and 2. a bottom piece;

B. a corner extension beam, said corner extension beam further comprising a first end and a second end;

C. an arm coupled substantially perpendicular to said first end of said corner extension beam;

D. a support bracket coupled to said second end of said corner extension beam;

E. said arm of said corner extension beam is coupled to said slot on said top piece of said mounting bracket; and F. said top piece of said mounting bracket is adjustably connected to said bottom piece of said mounting bracket such that said mounting bracket attaches to structures of varying dimensions.

2. The mounting system of claim 1 wherein:

A said top piece of said mounting bracket further comprises a first overlapping member, said first overlapping member further comprising:

1. at least one hole;

2. an inside; and 3. an outside;

B. said bottom piece of said mounting bracket further comprises a second overlapping member, said second overlapping member further comprising:

1. at least one hole;

2. an inside; and 3. an outside;

C. said outside of said first overlapping member slides along said inside of said second overlapping member such that said holes of said first overlapping member and said second overlapping member are aligned along an axis substantially perpendicular to each other; and D. at least one securing member is inserted into said holes to adjustably connect said first overlapping member of said top piece of said mounting bracket to said second overlapping member of said bottom piece of said mounting bracket.

3. The mounting system of claim 2 wherein:

A. said mounting system further comprises at least one cantilever beam, such that said cantilever beam is pivotally coupled to said support bracket.

4. The mounting system of claim 3 wherein:

A. said mounting system further comprises a pair of cantilever beams, said cantilever beams are pivotally coupled to said support bracket with a plurality of pivot pins, such that said pivot pins are positioned substantially perpendicular to each other; and B. said pivot pins include an axis, such that said cantilever beams rotate about said axis of said pivot pins.

5. The mounting system of claim 4 wherein:

A said support bracket is positioned at an end of said corner extension beam, such that said cantilever beams are released into an open position on both sides of a corner of a structure.

6. A method for using a mounting system comprising the steps of:

A. coupling an arm to a first end of a corner extension beam;

B. coupling a support bracket to a second end of said corner extension beam;

C. coupling said arm of said corner extension beam to a slot on a top piece of a mounting bracket; and D. connecting said top piece of said mounting bracket adjustably to a bottom piece of said mounting bracket such that said mounting bracket attaches to structures of varying dimensions.

7. The method of claim 6 further comprising the steps of:

A. sliding an outside of a first overlapping member of said top piece of said mounting bracket along an inside of a second overlapping member of said bottom piece of said mounting bracket;

B. aligning at least one hole of said first overlapping member with at least one hole of said second overlapping member along an axis where the hole of said first overlapping member is substantially perpendicular to said hole of said second overlapping member, and C. inserting at least one securing member into said holes to adjustably connect said first overlapping member of said top piece of said mounting bracket to said second overlapping member of said bottom piece of said mounting bracket.

8. The method of claim 7 further comprising the step of coupling at least one cantilever beam pivotally to said support bracket.

9. The method of claim 8 further comprising the steps of:

A. pivotally coupling a pair of cantilever beams to said support bracket with a plurality of pivot pins, such that said pivot pins are positioned substantially perpendicular to each other, and B. rotating said cantilever beams around an axis of said pivot pins.

10. The method of claim 9 further comprising the step of positioning said support bracket at an end of said corner extension beam, such that said cantilever beams are released into an open position on both sides of a corner of a structure.

* * * * *